US011270638B2

(12) United States Patent
Dong

(10) Patent No.: US 11,270,638 B2
(45) Date of Patent: Mar. 8, 2022

(54) DISPLAY COMPENSATION CIRCUIT AND METHOD FOR CONTROLLING THE SAME, AND DISPLAY APPARATUS

(71) Applicant: BOE TECHNOLOGY GROUP CO., LTD., Beijing (CN)

(72) Inventor: Tian Dong, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 64 days.

(21) Appl. No.: 16/960,976

(22) PCT Filed: Jan. 13, 2020

(86) PCT No.: PCT/CN2020/071745
§ 371 (c)(1),
(2) Date: Jul. 9, 2020

(87) PCT Pub. No.: WO2020/151517
PCT Pub. Date: Jul. 30, 2020

(65) Prior Publication Data

US 2021/0375205 A1 Dec. 2, 2021

(30) Foreign Application Priority Data

Jan. 24, 2019 (CN) ..... 201910067834.7

(51) Int. Cl.
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2300/043* (2013.01); *G09G 2320/029* (2013.01)

(58) Field of Classification Search
None
See application file for complete search history.

(56) References Cited

U.S. PATENT DOCUMENTS 8,284,126 B2 10/2012 Kwon
9,123,296 B2 9/2015 Nam et al.
(Continued)

FOREIGN PATENT DOCUMENTS

CN 104658476 A 5/2015
CN 104732920 A 6/2015
(Continued)

OTHER PUBLICATIONS

Office Action dated Jan. 2, 2020, issued in counterpart CN Application No. 201910067834.7, with English translation (16 pages).

*Primary Examiner* — Dorothy Harris
(74) *Attorney, Agent, or Firm* — Westerman, Hattori, Daniels & Adrian, LLP

(57) ABSTRACT

The present disclosure discloses a display compensation circuit and a method for controlling the same, and a display apparatus. The display compensation circuit comprises a pixel circuit and a power supply selection circuit. The pixel circuit comprises: a light-emitting control sub-circuit; a driving transistor; a first compensation sub-circuit; a second compensation sub-circuit; and a light-emitting element. The power supply selection circuit is coupled to the first power supply terminal, the second power supply terminal, a first switch control terminal, a second switch control terminal and the third node respectively, and is configured to selectively transmit a first power supply signal at the first power supply terminal and a second power supply signal at the second power supply terminal to the third node under control of the first switch control terminal and the second switch control terminal.

14 Claims, 6 Drawing Sheets

(56) References Cited

U.S. PATENT DOCUMENTS

| | | | | |
|---|---|---|---|---|
| 9,761,177 | B2 | 9/2017 | Mizukoshi | |
| 9,922,599 | B2 | 3/2018 | Li et al. | |
| 10,062,326 | B2 | 8/2018 | Takizawa et al. | |
| 10,304,385 | B2 | 5/2019 | Takizawa et al. | |
| 10,541,292 | B2 | 1/2020 | Lim et al. | |
| 10,706,788 | B2 | 7/2020 | Chen et al. | |
| 2005/0068271 | A1 | 3/2005 | Lo | |
| 2007/0024544 | A1* | 2/2007 | Chung | G09G 3/3291 345/76 |
| 2008/0252569 | A1 | 10/2008 | Kwon | |
| 2009/0295422 | A1* | 12/2009 | Hamer | G09G 3/3233 324/760.02 |
| 2009/0295423 | A1* | 12/2009 | Levey | G09G 3/006 324/760.01 |
| 2012/0169704 | A1* | 7/2012 | Chung | G09G 3/3233 345/212 |
| 2015/0145845 | A1 | 5/2015 | Nam et al. | |
| 2015/0179105 | A1 | 6/2015 | Mizukoshi | |
| 2016/0163251 | A1 | 6/2016 | Kwon et al. | |
| 2017/0011687 | A1 | 1/2017 | Li et al. | |
| 2017/0025061 | A1 | 1/2017 | Takizawa et al. | |
| 2018/0182283 | A1 | 6/2018 | Lim et al. | |
| 2018/0350301 | A1 | 12/2018 | Takizawa et al. | |
| 2020/0082767 | A1* | 3/2020 | Chen | G09G 3/3233 |

FOREIGN PATENT DOCUMENTS

| | | | |
|---|---|---|---|
| CN | 104978931 | A | 10/2015 |
| CN | 106165007 | A | 11/2016 |
| CN | 106782333 | A | 5/2017 |
| CN | 106856086 | A | 6/2017 |
| CN | 108257546 | A | 7/2018 |
| CN | 108346400 | A | 7/2018 |
| CN | 109523952 | A | 3/2019 |
| KR | 20070027265 | A | 3/2007 |
| KR | 100846969 | B1 | 7/2008 |

* cited by examiner

DISPLAY COMPENSATION CIRCUIT AND METHOD FOR CONTROLLING THE SAME, AND DISPLAY APPARATUS

CROSS-REFERENCE TO RELATED APPLICATION(S)

This application claims priority to the Chinese Patent Application No. CN201910067834.7, filed on Jan. 24, 2019, which is incorporated herein by reference in its entirety.

TECHNICAL FIELD

The present disclosure relates to the field of display technology, and more particularly, to a display compensation circuit and a method for controlling the same, and a display apparatus.

BACKGROUND

Organic Light-emitting Diodes (OLEDs for short), as current-type light-emitting devices, have advantages such as self-luminescence, a fast response, a wide viewing angle, and an ability of being manufactured on a flexible substrate etc., and thus are widely used in the field of high-performance display.

In the related art, each pixel in an OLED display apparatus is coupled to a pixel driving circuit, and the pixel driving circuit comprises a driving transistor to output driving current to a light-emitting element. Due to limitations of a process of manufacturing the driving transistor, different driving transistors have different threshold voltages and mobility, and thereby current flowing through the light-emitting device may be different due to the difference in terms of the threshold voltages and the mobility of the driving transistors, which may thus cause unevenness of brightness and affect display quality.

SUMMARY

In a first aspect, the embodiments of the present disclosure provide a display compensation circuit, comprising a pixel circuit and a power supply selection circuit, wherein the pixel circuit comprises:

a light-emitting control sub-circuit, respectively coupled to a data signal terminal, a scanning signal terminal, a first node and a first power supply terminal, and configured to transmit a data signal at the data signal terminal to the first node under control of the scanning signal terminal;

a driving transistor having a control electrode coupled to the first node, a first electrode coupled to the first power supply terminal, and a second electrode coupled to a second node;

a first compensation sub-circuit respectively coupled to the first node, the second node and a first control terminal, and configured to transmit a voltage at the first node to the second node under control of the first control terminal;

a second compensation sub-circuit respectively coupled to the second node, a second control terminal and a detection signal terminal, and configured to transmit a voltage at the second node to the detection signal terminal under control of the second control terminal; and a light-emitting element respectively coupled to the second node and a third node, wherein the power supply selection circuit is coupled to the first power supply terminal, the second power supply terminal, a first switch control terminal, a second switch control terminal and the third node respectively, and is configured to selectively transmit a first power supply signal at the first power supply terminal and a second power supply signal at the second power supply terminal to the third node under control of the first switch control terminal and the second switch control terminal, wherein the first compensation sub-circuit and the second compensation sub-circuit are configured to cause the detection signal terminal to output voltages respectively corresponding to a threshold voltage and mobility of the driving transistor under control of the scanning signal terminal, the first control terminal, and the second control terminal, and wherein the light-emitting control sub-circuit and the power supply selection sub-circuit are further configured to compensate for the threshold voltage and the mobility of the driving transistor based on the compensation, voltages which are obtained according to the threshold voltage and the mobility and control the driving transistor to drive the light-emitting element to emit light under control of the scanning signal terminal, the first switch control terminal and the second switch control terminal.

In the embodiments of the present disclosure, the light-emitting control sub-circuit transmits a first data signal, a second data signal and a third data signal at the data signal input terminal to the first node in different phases under control of the scanning signal terminal to control the driving transistor to be turned on; and the third data signal is obtained according to the compensation voltages.

In the embodiments of the present disclosure, the light-emitting control sub-circuit comprises a first switching transistor and a storage capacitor, wherein the first switching transistor has a control electrode coupled to the scanning signal terminal, a first electrode coupled to the data signal terminal, and a second electrode coupled to the first node; and the storage capacitor has a first terminal coupled to the first node, and a second terminal coupled to the first electrode of the driving transistor.

In the embodiments of the present disclosure, the first compensation sub-circuit comprises a second switching transistor, wherein the second switching transistor has a control electrode coupled to the first control terminal, a first electrode coupled to the first node, and a second electrode coupled to the second node.

In the embodiments of the present disclosure, the second compensation sub-circuit comprises a third switching transistor, wherein the third switching transistor has a control electrode coupled to the second control terminal, a first electrode coupled to the second node, and a second electrode coupled to the detection signal terminal.

In the embodiments of the present disclosure, in a threshold voltage detection phase, when the first data signal is transmitted to the first node, the second switching transistor and the third switching transistor are turned on under control of the first control terminal and the second control terminal, and during a first preset period of time, the detection signal terminal is in a floating state, the first power supply terminal charges the first node until the driving transistor is turned off, and the voltage at the first node is output to the detection signal terminal to obtain the threshold voltage.

In the embodiments of the present disclosure, in a mobility detection phase, when the second data signal is transmitted to the first node, the second switching transistor is turned off and the third switching transistor is turned on under control of the first control terminal and the second control terminal, and during a second preset period of time the first power supply terminal charges the second node, and the voltage at the second node is output to the detection signal terminal to obtain the mobility.

In the embodiments of the present disclosure, in a light-emitting display phase, when the third data signal is transmitted to the first node, the second switching transistor and the third switching transistor are turned off under control of the first control terminal and the second control terminal, and the driving transistor outputs driving current for driving the light-emitting element to emit light to the second node.

In the embodiments of the present disclosure, the power supply selection circuit comprises a fourth switching transistor and a fifth switching transistor, wherein the fourth switching transistor has a control electrode coupled to the first switch control terminal, a first electrode coupled to the third node, and a second electrode coupled to the first power supply terminal; and the fifth switching transistor has a control electrode coupled to the second switch control terminal, a first electrode coupled to the third node, and a second electrode coupled to the second power supply terminal.

In the embodiments of the present disclosure, when the fourth switching transistor is turned on and the fifth switching transistor is turned off under control of the first switch control terminal and the second switch control terminal, a signal at the first power supply terminal is transmitted to the third node; and when the fourth switching transistor is turned off and the fifth switching transistor is turned on under control of the first switch control terminal and the second switch control terminal, a signal at the second power supply terminal is transmitted to the third node.

In the embodiments of the present disclosure, the first switching transistor and the second switching transistor are oxide thin film transistors.

In the embodiments of the present disclosure, the power supply selection circuit is shared by a row of pixel circuits.

In a second aspect, the embodiments of the present disclosure provide a display apparatus comprising the display compensation circuit described above and a display panel.

In a third aspect, the embodiments of the present disclosure provide a method for controlling the display compensation circuit described above, comprising:

controlling, in a threshold voltage detection phase, a first data signal to be transmitted to the first node to obtain a threshold voltage of the driving transistor, controlling, in a mobility detection phase, a second data signal to be transmitted to the first node to obtain mobility of the driving transistor, and controlling, in a light-emitting display phase, a third data signal to be transmitted to the first node to compensate for the driving transistor according to the threshold voltage and the mobility, and controlling the driving transistor to drive the light-emitting element to emit light.

BRIEF DESCRIPTION OF THE ACCOMPANYING DRAWINGS

The accompanying drawings are used to provide a further understanding of the technical solutions according to the present disclosure, and form a part of the specification. The accompanying drawings are used to explain the technical solutions according to the present disclosure together with the embodiments of the present application, and do not constitute limitations on the technical solutions according to the present disclosure.

DETAILED DESCRIPTION

In order to make the purposes, technical solutions and advantages of the present disclosure more clear, the embodiments of the present disclosure will be described below in detail in conjunction with the accompanying drawings. It should be illustrated that the embodiments in the present application and the features in the embodiments may be randomly combined with each other without a conflict.

The steps shown in the flowcharts of the figures may be performed in a computer system such as a set of computer-executable instructions. Further, although a logical order is shown in the flowcharts, in some cases, the steps shown or described may be performed in an order different from that here.

Unless otherwise defined, the technical terms or scientific terms used in the embodiments of the present disclosure should have the usual meanings understood by those skilled in the art to which the present disclosure belongs. The terms "first", "second" and similar words used in the embodiments of the present disclosure do not indicate any order, quantity or importance, but are only used to distinguish different components. Similar words such as "comprise" or "include" mean that an element or item appearing before the word cover elements or items listed after the word and their equivalents, but do not exclude other elements or items. "Connected with" or "connected to" and similar words are not limited to physical or mechanical connections, but may include electrical connections, whether direct or indirect.

A source and a drain of a switching transistor used in all embodiments of the present disclosure are symmetrical, and therefore the source and the drain are interchangeable. In the embodiments of the present disclosure, in order to distinguish two electrodes of the switching transistor except for a gate, a source of the two electrodes is referred to as a first electrode and a drain of the two electrodes is referred to as a second electrode, and the gate is referred to as a control electrode. In addition, the switching transistors used in the embodiments of the present disclosure comprise P-type switching transistors or N-type switching transistors, wherein the P-type switching transistors are turned on when a gate thereof is at a low level, and are turned off when the gate is at a high level, and the N-type switching transistors are turned on when a gate thereof is at a high level, and are turned off when the gate is at a low level.

Figure 1:
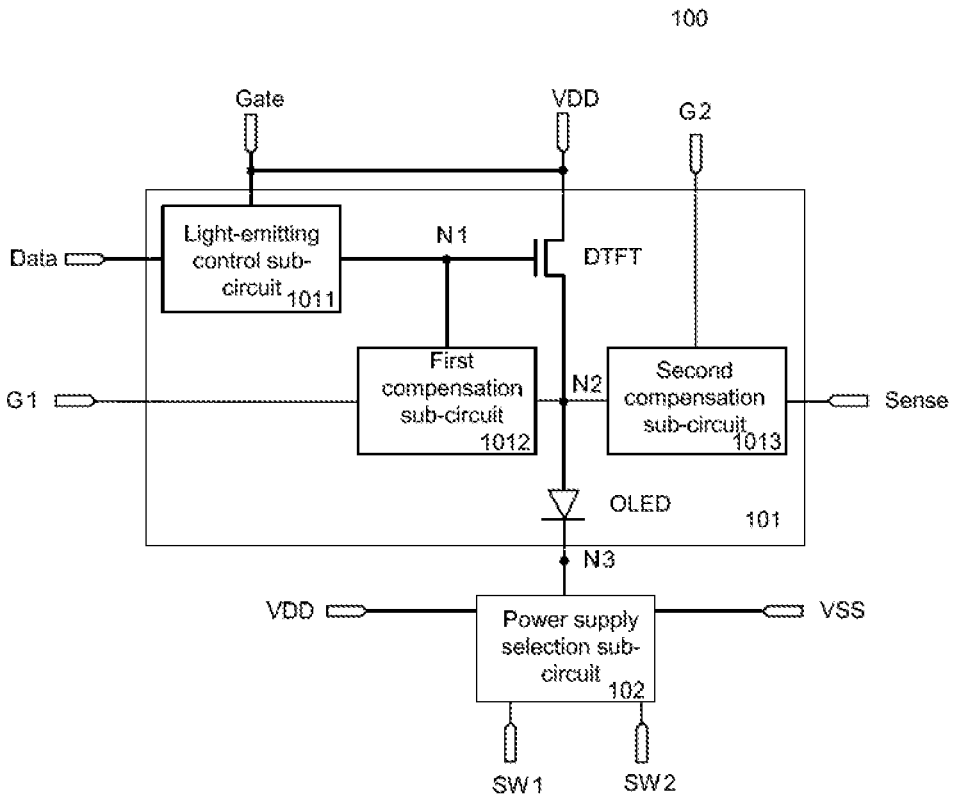
FIG. 1 is a schematic structural diagram of a display compensation circuit according to an embodiment of the present disclosure.

The embodiments of the present disclosure provide a display compensation circuit. FIG. 1 is a schematic structural diagram of a display compensation circuit 100 according to an embodiment of the present disclosure. As shown in FIG. 1, the display compensation circuit 100 according to the embodiment of the present disclosure comprises a pixel circuit 101 and a power supply selection circuit 102. The pixel circuit 101 comprises a light-emitting control sub-circuit 1011, a driving transistor DTFT, a first compensation sub-circuit 1012, a second compensation sub-circuit 1013, and a light-emitting element OLED.

Specifically, the light-emitting control sub-circuit 1011 is coupled to a data signal terminal Data, a scanning signal terminal Gate, a first node N1 and a first power supply terminal VDD respectively. The driving transistor DTFT has a control electrode coupled to the first node N1, a first electrode coupled to the first power supply terminal VDD, and a second electrode coupled to a second node N2. The first compensation sub-circuit 1012 is coupled to the first node N1, the second node N2, and a first control terminal G1 respectively. The second compensation sub-circuit 1013 is coupled to the second node N2, a second control terminal G2 and a detection signal terminal Sense respectively. The light-emitting element is coupled to the second node and a third node respectively. The power supply selection circuit 102 is coupled to the first power supply terminal VDD, a second power supply terminal VSS, a first switch control terminal SW1, a second switch control terminal SW2, and the third node N3 respectively.

The first compensation sub-circuit 1012 and the second compensation sub-circuit 1013 are configured to cause the detection signal terminal Sense to output voltages respectively corresponding to a threshold voltage and mobility of the driving transistor DTFT under control of the scanning signal terminal Gate, the first control terminal G1, and the second control terminal G2. Further, the light-emitting control sub-circuit 1011 and the power supply selection circuit 102 are further configured to compensate for the threshold voltage and the mobility of the driving transistor based on the compensation voltages which are obtained according to the threshold voltage and the mobility and control the driving transistor DTFT to drive the light-emitting element to emit light under control of the scanning signal terminal Gate, the first switch control terminal SW1 and the second switch control terminal SW2. Alternatively, the power supply selection circuit may be shared by a row of pixel circuits when the light-emitting element is driven to emit light.

In this embodiment, the first power supply terminal VDD continuously provides a high-level signal, the second power supply terminal VSS continuously provides a low-level signal, and the driving transistor DTFT is a P-type low-temperature polysilicon thin film transistor.

In the embodiment, the driving transistor DTFT may be an enhancement transistor or a depletion transistor, which is not specifically limited here. It should be illustrated that a P-type driving transistor is in an amplified state or a saturated state when a gate voltage thereof is at a low level (the gate voltage is less than a source voltage), and an absolute value of a difference between the gate voltage and the source voltage is greater than a threshold voltage.

Specifically, the light-emitting control sub-circuit 1011 is used to provide a signal at the data signal terminal Data to the first node N1 under control of the scanning control terminal Gate, and is also used to store a voltage difference between a signal at the first node N1 and a signal at the first power supply terminal VDD, and the driving transistor DTFT is used to provide driving current to the second node N2 under control of the first node N1. The first compensation sub-circuit 1012 is used to provide the voltage signal at the first node N1 to the second node N2 under control of the first control terminal G1. The second compensation sub-circuit is used to read a voltage signal at the second node N2 under control of the second control terminal G2. The power supply selection circuit 102 is used to provide the high-level signal at the first power supply terminal VDD to the third node N3 under control of the first switch control terminal SW1, or provide the low-level signal at the second power supply terminal VSS to the third node N3 under control of the second switch control terminal SW2.

In an embodiment, as shown in FIG. 1, the light-emitting element may be an Organic Light-Emitting Diode (OLED for short).

The display compensation circuit according to the embodiment of the present disclosure comprises the pixel circuit and the power supply selection circuit. Here, the pixel circuit comprises a light-emitting control sub-circuit respectively coupled to the data signal terminal, the scanning signal terminal, the first node and the first power supply terminal, and configured to transmit the data signal at the data signal terminal to the first node under control of the scanning signal terminal; the driving transistor having the control electrode coupled to the first node, the first electrode coupled to the first power supply terminal, and the second electrode coupled to the second node; the first compensation sub-circuit respectively coupled to the first node, the second node and the first control terminal, and configured to transmit the voltage at the first node to the second node under control of the first control terminal; the second compensation sub-circuit respectively coupled to the second node, the second control terminal and the detection signal terminal, and configured to transmit the voltage at the second node to the detection signal terminal under control of the second control terminal; and the light-emitting element coupled to the second node and the third node. The power supply selection circuit is coupled to the first power supply terminal, the second power supply terminal, the first switch control terminal, the second switch control terminal and the third node respectively, and is configured to selectively transmit a first power supply signal at the first power supply terminal and a second power supply signal at the second power supply terminal to the third node under control of the first switch control terminal and the second switch control terminal. The first compensation sub-circuit and the second compensation sub-circuit are configured to cause the detection signal terminal to output the voltages respectively corresponding to the threshold voltage and the mobility of the driving transistor under control of the scanning signal terminal, the first control terminal, and the second control terminal, and the light-emitting control sub-circuit and the power supply selection circuit are further configured to compensate for the threshold voltage and the mobility of the driving transistor based on the compensation voltages which are obtained according to the threshold voltage and the mobility and control the driving transistor to drive the light-emitting element to emit light under control of the scanning signal terminal, the first switch control terminal and the second switch control terminal. With the embodiment of the present disclosure, the threshold voltage and the mobility of the driving transistor are obtained by means of external compensation, and the compensation voltages are obtained according to the threshold voltage and the mobility to drive the light-emitting element to emit light, which offsets the influence of the threshold voltage and the mobility of the driving transistor on the driving current, that is, it may ensure the uniformity of display brightness, thereby improving the display image quality.

Figure 2:
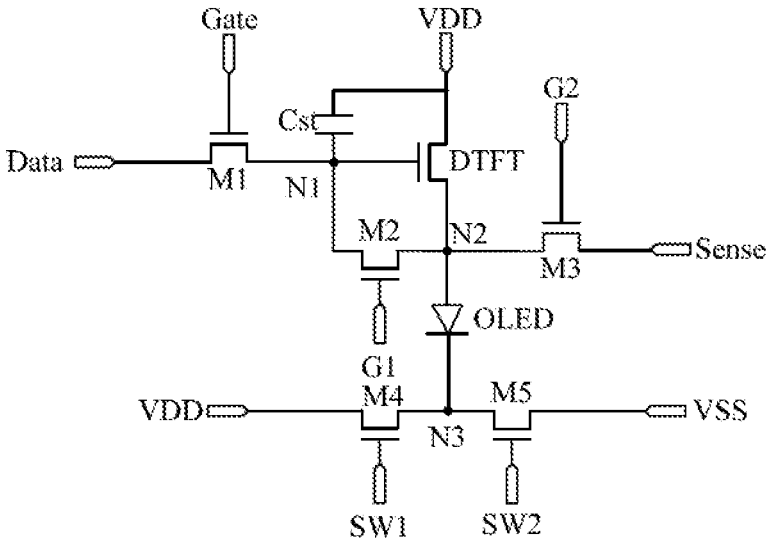
FIG. 2 is an equivalent circuit diagram of a display compensation circuit according to an embodiment of the present disclosure.

In an embodiment, FIG. 2 is an equivalent circuit diagram of a display compensation circuit according to an embodiment of the present disclosure. As shown in FIG. 2, the light-emitting control sub-circuit according to the embodiment of the present disclosure comprises: a first switching transistor M1 and a storage capacitor Cst.

Specifically, the first switching transistor M1 has a control electrode coupled to the scanning signal terminal Gate, a first electrode coupled to the data signal terminal Data, and a second electrode coupled to the first node N1; and the storage capacitor Cst has a first terminal coupled to the first node N1 and a second terminal coupled to the first electrode of the driving transistor DTFT.

In this embodiment, when the first switching transistor M1 is turned on under control of the scanning control terminal Gate, a first data signal, a second data signal, and a third data signal are transmitted to the first node N1 in different phases respectively to control the driving transistor DTFT to be turned on.

Specifically, the third data signal is obtained according to the compensation voltages, and the compensation voltages are obtained according to the threshold voltage and the mobility of the driving transistor DTFT.

In an embodiment, as shown in FIG. 2, the first compensation sub-circuit according to the embodiment of the present disclosure comprises a second switching transistor M2, and the second compensation sub-circuit according to the embodiment of the present disclosure comprises a third switching transistor M3.

Specifically, the second switching transistor M2 has a control electrode coupled to the first control terminal G1, a first electrode coupled to the first node N1, and a second electrode coupled to the second node N2; and the third switching transistor M3 has a control electrode coupled to the second control terminal G2, a first electrode coupled to the second node N2, and a second electrode coupled to the detection signal terminal Sense.

In this embodiment, when the first data signal is transmitted to the first node N1, the second switching transistor M2 and the third switching transistor M3 are turned on under control of the first control terminal G1 and the second control terminal G2, and during a first preset period of time, the detection signal terminal Sense is in a floating state, the first power supply terminal VDD charges the first node N1 until the driving transistor DTFT is turned off, and the voltage at the first node N1 is output to the detection signal terminal Sense to obtain the threshold voltage. When the second data signal is transmitted to the first node N1, the second switching transistor M2 is turned off and the third switching transistor M3 is turned on under control of the first control terminal G1 and the second control terminal G2, and during a second preset period of time, the first power supply terminal VDD charges the second node N2, and the voltage at the second node N2 is output to the detection signal terminal Sense to Obtain the mobility. When the third data signal is transmitted to the first node N1, the second switching transistor M2 and the third switching transistor M3 are turned off under control of the first control terminal G1 and the second control terminal G2, and driving current for driving the light-emitting element to emit light is output to the second node N2.

In an embodiment, the first preset period of time is 100 microseconds to 100 milliseconds.

In an embodiment, the second preset period of time is 10 microseconds to 100 microseconds.

In an embodiment, as shown in FIG. 2, the power supply selection circuit according to the embodiment of the present disclosure comprises a fourth switching transistor M4 and a fifth switching transistor M5.

Specifically, the fourth switching transistor M4 has a control electrode coupled to the first switch control terminal SW1, a first electrode coupled to the third node N3, and a second electrode coupled to the first power supply terminal VDD. The fifth switching transistor M5 has a control electrode coupled to the second switch control terminal SW2, a first electrode coupled to the third node N3, and a second electrode coupled to the second power supply terminal VSS.

In this embodiment, when the fourth switching transistor M4 is turned on and the fifth switching transistor M5 is turned off under control of the first switch control terminal SW1 and the second switch control terminal SW2, the signal at the first power supply terminal VDD is output to the third node N3, and when the fourth switching transistor M4 is turned off and the fifth switching transistor M5 is turned on under control of the first switch control terminal SW1 and the second switch control terminal SW2, the signal at the second power supply terminal VSS is output to the third node N3.

It should be illustrated that FIG. 2 specifically illustrates exemplary structures of the pixel circuit and the power supply selection circuit. It is easily understood by those skilled in the art that the implementations of the above circuits are not limited thereto, as long as they may implement respective functions.

In this embodiment, the driving transistor DTFT is a P-type low-temperature polysilicon thin film transistor, and the switching transistors M1 to M5 may all be N-type thin film transistors or P-type thin film transistors.

In order to unify the process flow, a number of processes may be reduced, which helps to improve the yield of the product. The driving transistor DTFT and the switching transistors M1 to M5 are all P-type transistors. In an embodiment, bottom-gate structure thin film transistors or top-gate structure thin film transistors may specifically be selected to be used as the thin film transistors, as long as they may implement a switching function.

In an embodiment, in order to reduce leakage current in the display compensation circuit and reduce power consumption, the first switching transistor M1 and the second switching transistor M2 may be oxide thin film transistors, wherein the first switching transistor M1 and the second switching transistor M2 are N-type oxide thin film transistors, and the remaining switching transistors may be P-type or N-type low-temperature polysilicon thin film transistors, which are not limited in the embodiments of the present disclosure.

Figure 3:
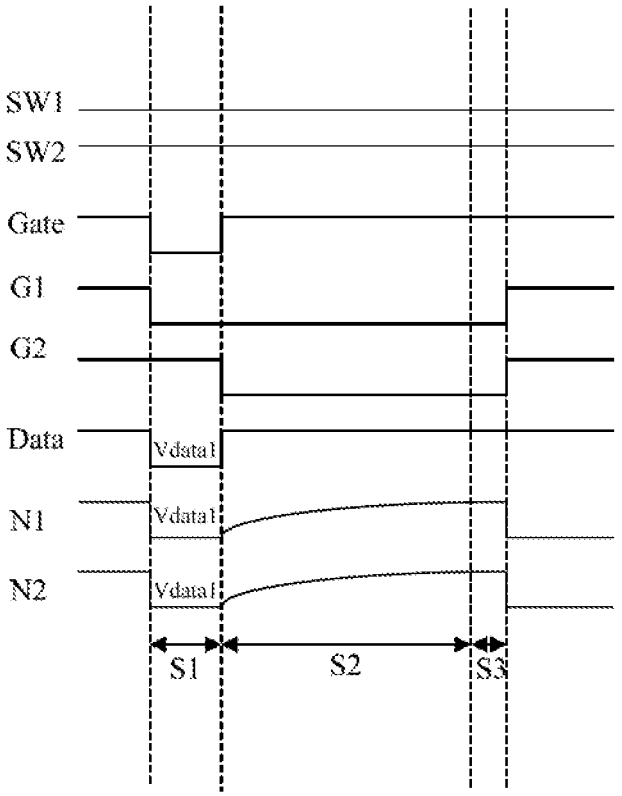
FIG. 3 is a signal timing diagram of a display compensation circuit in a threshold voltage detection phase according to an embodiment of the present disclosure.
Figure 4:
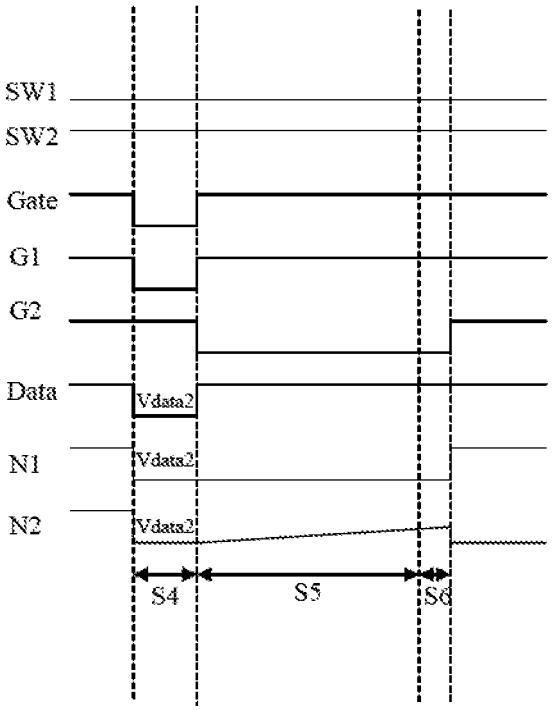
FIG. 4 is a signal timing diagram of a display compensation circuit in a mobility detection phase according to an embodiment of the present disclosure.
Figure 5:
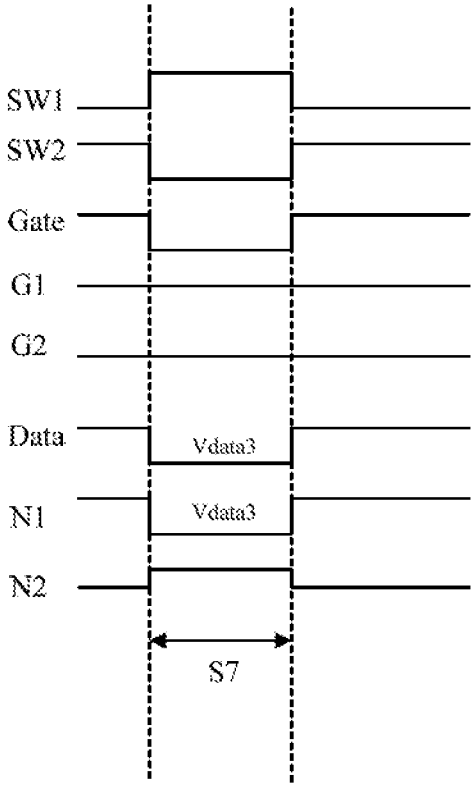
FIG. 5 is a signal timing diagram of a display compensation circuit in a light-emitting display phase according to an embodiment of the present disclosure.

By taking the switching transistors M1 to M5 in the display compensation circuit according to the embodiments of the present disclosure being all P-type thin film transistors as an example, FIG. 3 is a signal timing diagram of the display compensation circuit in a threshold voltage detection phase according to an embodiment of the present disclosure, FIG. 4 is a signal timing diagram of the display compensation circuit in a mobility detection phase according to an embodiment of the present disclosure, and FIG. 5 is a signal timing diagram of the display compensation circuit in a light-emitting display phase according to an embodiment of the present disclosure. As shown in FIGS. 3 to 5, the display compensation circuit according to the embodiment of the present disclosure comprises: five switching transistors (M1 to M5), one driving transistor (DTFT), one capacitor (Cst), seven input terminals (Data, Gate, G1, G2, Sense, SW1 and SW2) and two power supply terminals (VDD and VSS).

In this embodiment, an operating timing of the display compensation circuit comprises the threshold voltage detection phase, the mobility detection phase, and, the light-emitting display phase.

Here, in combination with FIG. 2 and FIG. 3, the threshold voltage detection phase comprises a first phase S1, a second phase S2 and a third phase S3. Details in these phases are as follows.

In the first phase S1, input signals at the scanning signal terminal Gate and the first control terminal G1 are at a low level, and the data signal terminal Data inputs a first data signal having a voltage value of Vdata1, and the first switching transistor M1 is turned on to provide a first data signal to the first node N1. At this time, a potential at the first node N1 is $V_1$=Vdata1, and the second switching transistor M2 is turned on to provide the signal at the first node N1 to the second node N2. In this phase, an input signal at the first switch control terminal SW1 is at a low level, the fourth switching transistor M4 is turned on, and a potential at the third node N3 is pulled up by a signal at the first power supply terminal VDD, so that a voltage at a cathode of the organic light-emitting diode OLED is greater than that at an anode thereof, and the organic light-emitting diode OLED does not emit light.

In the second phase S2, the input signal at the scanning signal terminal Gate is at a high level, the first switching transistor M1 is turned off, input signals at the first control terminal G1 and the second control terminal G2 are at a low level, the second switching transistor M2 and the third switching transistor M3 are turned on, and the detection signal terminal Sense is in a floating state. Since the driving transistor DTFT and the second switching transistor M2 are both in a turn-on state, during the first preset period of time, the first power supply terminal VDD charges the first node N1 through the driving transistor DTFT and the second switching transistor M2 until the potential $V_1$ at the first node N1 is equal to Vdd+Vth, wherein Vdd is a voltage value at the first power supply terminal VDD. In this phase, the input signal at the first switch control terminal SW1 continues to be at a low level, so that the organic light-emitting diode OLED does not emit light.

In the third phase S3, the input signals at the first control terminal G1 and the second control terminal G2 are still at a low level, and the second switching transistor M2 and the third switching transistor M3 are turned on. At this time, a potential $V_2$ at the second node N2 is equal to $V_1$=Vdd+Vth, and the detection signal terminal Sense reads the potential at the second node N2. The potential at the second node N2 is provided to an external control circuit (for example, an Integrated Chip (IC)), so that the external control circuit obtains a threshold voltage Vth of the driving transistor DTFT according to $V_2$.

As shown in FIGS. 2 and 4, the mobility detection phase comprises a fourth phase S4, a fifth phase S5, and a sixth phase S6. Details in these phases are as follows.

In the fourth phase S4, the signals at the scanning signal terminal Gate and the first control terminal G1 are at a low level, the data signal terminal Data inputs a second data signal having a voltage value of Vdata2, and the first switching transistor M1 is turned on to provide the second data signal to the first node N1. At this time, the potential $V_1$ at the first node N1 is equal to Vdata2, and the second switching transistor M2 is turned on to provide the signal at the first node N1 to the second node N2. In this phase, the input signal at the first switch control terminal SW1 is at a low level, the fourth switching transistor M4 is turned on, and the potential at the third node N3 is pulled high by the signal at the first power supply terminal VDD, so that the voltage at the cathode of the organic light-emitting diode OLED is greater than that at the anode thereof, and the organic light-emitting diode OLED does not emit light.

In the fifth phase S5, the input signals at the scanning signal terminal Gate and the first control terminal G1 are at a high level, the first switching transistor M1 and the second switching transistor M2 are turned off, the input signal at the second control terminal G2 is at a low level, the third switching transistor M3 is turned on, the potential at the first node N1 still satisfies $V_1$=Vdata2, the driving transistor DTFT is turned on, the first power supply terminal VDD charges the second node N2 during the second preset period of time, and the potential $V_2$ at the second node N2 is equal to VA after the second preset period of time elapses. In this phase, the input signal at the first switch control terminal SW1 continues to be at a low level, so that the organic light-emitting diode OLED does not emit light.

In the sixth phase S6, the input signals at the scanning signal terminal Gate and the first control terminal G1 are at a high level, the first switching transistor M1 and the second switching transistor M2 are turned off, the input signal at the second control terminal G2 is at a low level, the third switching transistor M3 is turned on, and the detection signal terminal Sense reads the potential VA at the second node N2. This potential VA is provided to an external control circuit, so that the external control circuit obtains mobility K of the driving transistor DTFT according to VA and the threshold voltage Vth, and obtains a compensation voltage VK according to the threshold voltage VA and the mobility K. In this phase, the input signal at the first switch control terminal SW1 continues to be at a low level, so that the organic light-emitting diode OLEO does not emit light.

Specifically, the mobility K and the threshold voltage Vth satisfy:

$$C*(VA-V\text{data}2)/T=\tfrac{1}{2}K(V\text{data}2-Vdd-Vth)^2$$

where C is a capacitance value of the storage capacitor Cst and T is the second preset period of time.

In this embodiment, in order to ensure normal display, the input signal at the first switch control terminal SW1 is continuously at a low level in the threshold voltage detection phase and the mobility detection phase to ensure that the organic light-emitting diode OLED does not emit light.

As shown in FIGS. 2 and 5, the light-emitting display phase comprises a seventh phase S7. Details in this phase are as follows.

In the seventh phase S7, the input signal at the scanning control terminal Gate is at a low level, the first switching transistor M1 is turned on, and the data signal terminal Data inputs a third data signal having a voltage value of Vdata3 to control the driving transistor DTFT to be turned on to provide driving current to the second node N2. In this phase, the input signal at the second switch control terminal SW2 is at a low level, the fifth switching transistor M5 is turned on, and the potential at the third node N3 is pulled down by the low-level signal at the second power supply terminal. At this time, the voltage at the anode of the organic light-emitting diode OLED is higher than that at the cathode thereof, and the organic light-emitting diode OLED emits light.

In this embodiment, the third data signal is obtained by the external control circuit according to the compensation voltage. In the light-emitting display phase, the third data signal is input to the control electrode of the driving transistor, and the threshold voltage and the mobility of the driving transistor DTFT may be compensated when the organic light-emitting diode OLED emits light, which ensures the uniformity of the display and improves the display effect.

Figure 6:
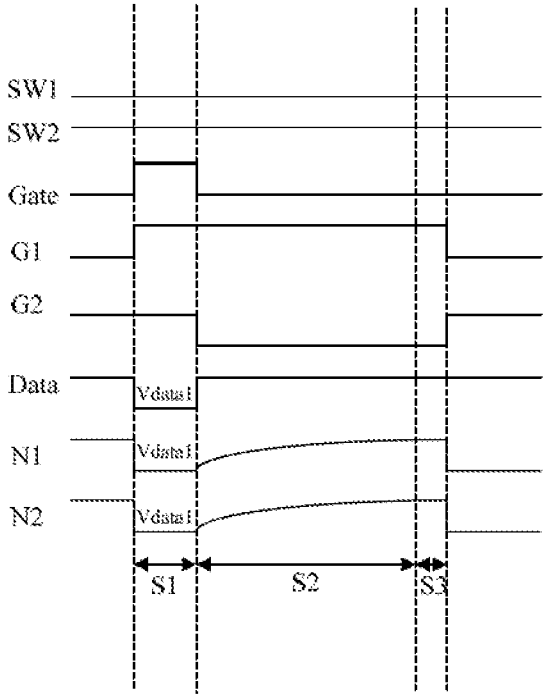
FIG. 6 is another signal timing diagram of a display compensation circuit in a threshold voltage detection phase according to an embodiment of the present disclosure.
Figure 7:
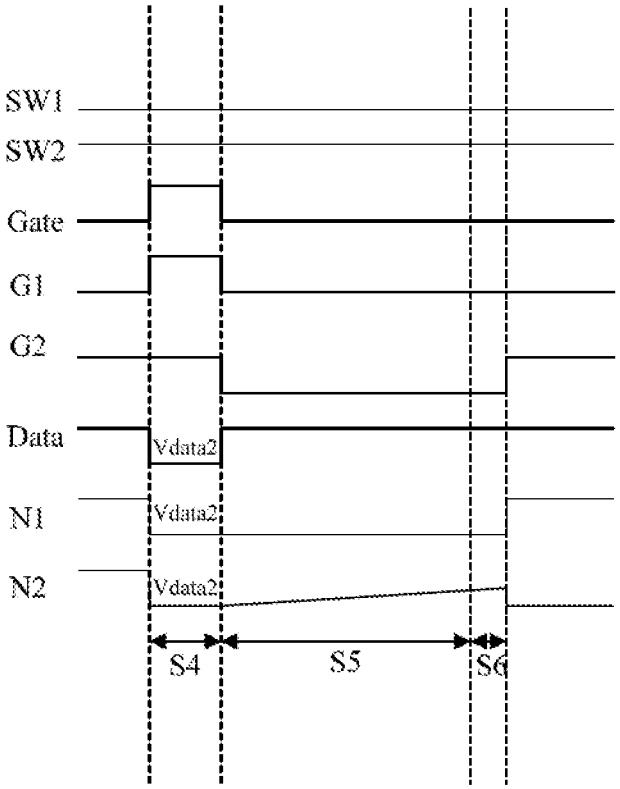
FIG. 7 is another signal timing diagram of a display compensation circuit in a mobility detection phase according to an embodiment of the present disclosure.
Figure 8:
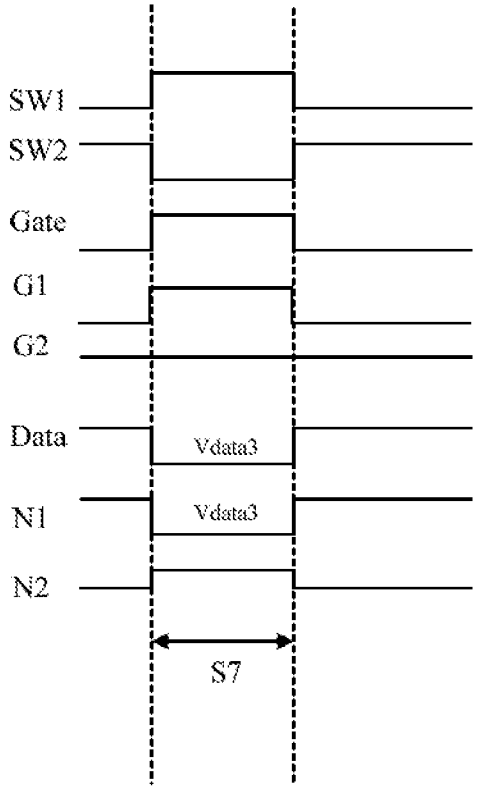
FIG. 8 is another signal timing diagram of a display compensation circuit in a light-emitting display phase according to an embodiment of the present disclosure.

It should be illustrated that the above embodiments are described by taking the switching transistors M1 to M5 being all P-type low-temperature polysilicon thin film transistors as an example. If the first switching transistor M1 and the second switching transistor M2 are oxide thin film transistors, the remaining switching transistors are all P-type low-temperature polysilicon thin film transistors. FIG. 6 is another signal timing diagram of a display compensation circuit in a threshold voltage detection phase according to an embodiment of the present disclosure, FIG. 7 is another signal timing diagram of a display compensation circuit in a mobility detection phase according to an embodiment of the present disclosure, and FIG. 8 is another signal timing diagram of a display compensation circuit in a light-emitting display phase according to an embodiment of the present disclosure. FIGS. 6-8 have similar operating principles as those of FIGS. 3-5 respectively except for different timings of the input signals at the scanning signal terminal Gate and the first control terminal G1, and the operating principles will not be repeated here. It should be illustrated that, if the first switching transistor M1 and the second switching transistor M2 are oxide thin film transistors, the remaining switching transistors may also be N-type low-temperature polysilicon thin film transistors, which have similar operating principles as above, and the operating principles will not be repeated here.

Figure 9:
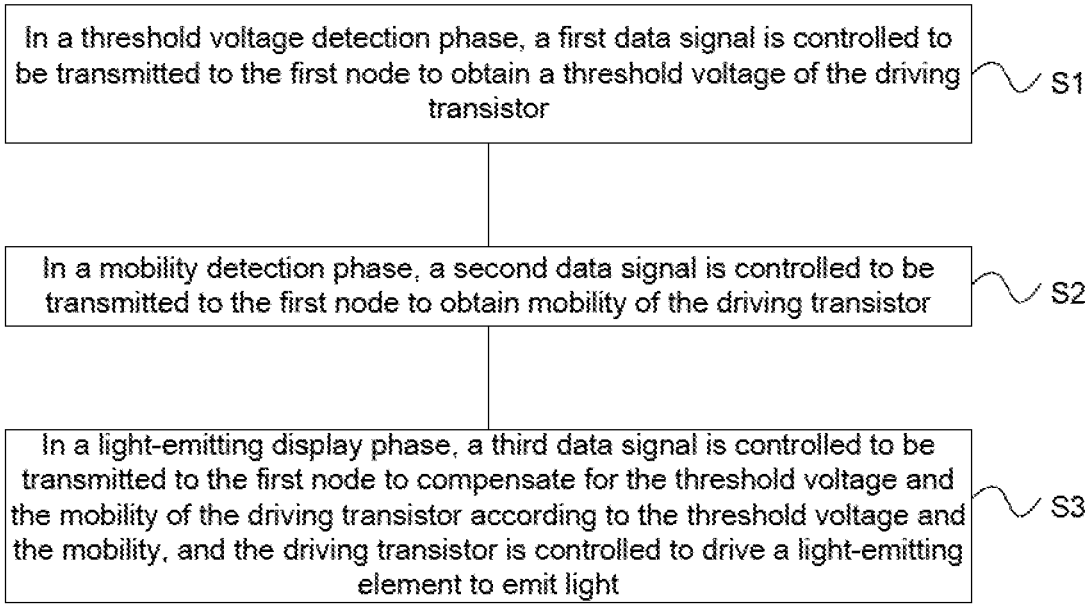
FIG. 9 is a flowchart of a method for controlling a display compensation circuit according to an embodiment of the present disclosure.

Based on the concept disclosed in the above embodiments, the embodiments of the present disclosure further provide a method for controlling a display compensation circuit. FIG. 9 is a flowchart of a method for controlling a display compensation circuit according to an embodiment of the present disclosure. As shown in FIG. 9, the method for controlling a display compensation circuit according to the embodiment of the present disclosure specifically comprises the following steps.

In step S1, in a threshold voltage detection phase, a first data signal is controlled to be transmitted to the first node to obtain a threshold voltage of the driving transistor.

Specifically, step S1 comprises: when the scanning control terminal controls the first switching transistor to be turned on, transmitting the first data signal to the first node to control the driving transistor to be turned on; and when the second switching transistor and the third switching transistor are controlled to be turned on by the first control terminal and the second control terminal, during a first preset period of time, the detection signal terminal being in a floating state, charging, by the first power supply terminal, the first node until the driving transistor is turned off, and outputting the voltage at the first node to the detection signal terminal to obtain the threshold voltage.

In step S2, in a mobility detection phase, a second data signal is controlled to be transmitted to the first node to obtain mobility of the driving transistor.

Specifically, when the scanning control terminal controls the first switching transistor to be turned on, the second data signal is transmitted to the first node to control the driving transistor to be turned on, the second switching transistor is controlled to be turned off and the third switching transistor is controlled to be turned on by the first control terminal and the second control terminal, and during a second preset period of time, the first power supply terminal charges the second node, and the voltage at the second node is output to the detection signal terminal to obtain the mobility.

In step S3, in a light-emitting display phase, a third data signal is controlled to be transmitted to the first node to compensate for the driving transistor according to the threshold voltage and the mobility, and the driving transistor is controlled to drive a light-emitting element to emit light.

Specifically, step S3 comprises: when the scanning control terminal controls the first switching transistor to be turned on, transmitting the third data signal to the first node to control the driving transistor to be turned on, and compensating for the threshold voltage and the mobility of the driving transistor. At the same time, the second switching transistor and the third switching transistor are controlled to be turned off by the first control terminal and the second control terminal, and driving current for driving the light-emitting element to emit light is output to the second node.

The method for controlling a display compensation circuit according to the embodiment of the present disclosure has similar implementation principles and effects as those of the display compensation circuit provided above, and the implementation principles and the effects will not be repeated here.

Figure 10:
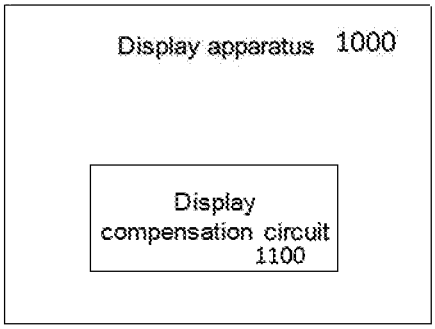
FIG. 10 is a schematic structural diagram of a display apparatus according to a embodiment of the present disclosure.

Based on the concept disclosed in the above embodiments, the embodiments of the present disclosure further provide a display apparatus. FIG. 10 is a schematic structural diagram of the display apparatus according to an embodiment of the present disclosure. As shown in FIG. 10, the display apparatus 1000 according to the embodiment of the present disclosure comprises a display compensation circuit 1100 and a display panel 1200.

Specifically, the display apparatus 1000 may comprise a display substrate, and the display compensation circuit 1100 may be disposed on the display substrate. Preferably, the display apparatus 1000 may be any product or component having a display function, such as a mobile phone, a tablet computer, a television, a display, a notebook computer, a digital photo frame, a navigator, etc.

Here, the display apparatus 1000 according to the embodiment of the present disclosure comprises the display compensation circuit according to the above embodiments, and has similar implementation principles and implementation effects as those described above, and the implementation principles and the implementation effects will not be repeated here.

The embodiments of the present disclosure only relate to the structures involved in the embodiments of the present disclosure, and other structures may be known with reference to general design.

The embodiments of the present disclosure and features in the embodiments may be combined with each other to obtain new embodiments without a conflict.

Although the embodiments disclosed in the present disclosure are as described above, the contents described are only the embodiments adopted to facilitate understanding of the present disclosure, and are not intended to limit the present disclosure. Any person skilled in the art to which the present disclosure belongs may make any modifications and changes in forms and details of implementations without departing from the spirit and scope disclosed in the present disclosure, and the patent protection scope of the present disclosure shall still be defined by the scope of the appended claims.

Although the present disclosure has been described with reference to several exemplary embodiments, it should be understood that the terms used are illustrative and exemplary rather than limiting. Since the present disclosure may be embodied in various forms without departing from the spirit or essence of the present disclosure, it should be understood that the above embodiments are not limited to any of the foregoing details, but should be widely interpreted within the spirit and scope defined by the appended claims. Therefore, all changes and modifications falling within the scope of the claims or their equivalents shall be covered by the appended claims.

I claim:

1. A display compensation circuit, comprising a pixel circuit and a power supply selection circuit, wherein the pixel circuit comprises:

a light-emitting control sub-circuit respectively coupled to a data signal terminal, a scanning signal terminal, a first node and a first power supply terminal, and configured to transmit a data signal at the data signal terminal to the first node under control of the scanning signal terminal;

a driving transistor having a control electrode coupled to the first node, a first electrode coupled to the first power supply terminal, and a second electrode coupled to a second node;

a first compensation sub-circuit respectively coupled to the first node, the second node and a first control terminal, and configured to transmit a voltage at the first node to the second node under control of the first control terminal;

a second compensation sub-circuit respectively coupled to the second node, a second control terminal and a detection signal terminal, and configured to transmit a voltage at the second node to the detection signal terminal under control of the second control terminal; and a light-emitting element respectively coupled to the second node and a third node, wherein the power supply selection circuit is coupled to the first power supply terminal, the second power supply terminal, a first switch control terminal, a second switch control terminal and the third node respectively, and is configured to selectively transmit a first power supply signal at the first power supply terminal and a second power supply signal at the second power supply terminal to the third node under control of the first switch control terminal and the second switch control terminal, wherein the first compensation sub-circuit and the second compensation sub-circuit are configured to cause the detection signal terminal to output voltages respectively corresponding to a threshold voltage and mobility of the driving transistor under control of the scanning signal terminal, the first control terminal, and the second control terminal, and wherein the light-emitting control sub-circuit and the power supply selection circuit are further configured to compensate for the threshold voltage and the mobility of the driving transistor based on the compensation voltages which are obtained according to the threshold voltage and the mobility and control the driving transistor to drive the light-emitting element to emit light under control of the scanning signal terminal, the first switch control terminal and the second switch control terminal.

2. The display compensation circuit according to claim 1, wherein the light-emitting control sub-circuit transmits a first data signal, a second data signal and a third data signal at the data signal input terminal to the first node in different phases under control of the scanning signal terminal to control the driving transistor to be turned on; and the third data signal is obtained according to the compensation voltages.

3. The display compensation circuit according to claim 2, wherein the light-emitting control sub-circuit comprises a first switching transistor and a storage capacitor, wherein the first switching transistor has a control electrode coupled to the scanning signal terminal, a first electrode coupled to the data signal terminal, and a second electrode coupled to the first node; and the storage capacitor has a first terminal coupled to the first node, and a second terminal coupled to the first electrode of the driving transistor.

4. The display compensation circuit according to claim 2, wherein the first compensation sub-circuit comprises a second switching transistor, wherein the second switching transistor has a control electrode coupled to the first control terminal, a first electrode coupled to the first node, and a second electrode coupled to the second node.

5. The display compensation circuit according to claim 4, wherein the second compensation sub-circuit comprises a third switching transistor, wherein the third switching transistor has a control electrode coupled to the second control terminal, a first electrode coupled to the second node, and a second electrode coupled to the detection signal terminal.

6. The display compensation circuit according to claim 5, wherein in a threshold voltage detection phase, when the first data signal is transmitted to the first node, the second switching transistor and the third switching transistor are turned on under control of the first control terminal and the second control terminal, and during a first preset period of time, the detection signal terminal is in a floating state, the first power supply terminal charges the first node until the driving transistor is turned off, and the voltage at the first node is output to the detection signal terminal to obtain the threshold voltage.

7. The display compensation circuit according to claim 6, wherein in a mobility detection phase, when the second data signal is transmitted to the first node, the second switching transistor is turned off and the third switching transistor is turned on under control of the first control terminal and the second control terminal, and during a second preset period of time, the first power supply terminal charges the second node, and the voltage at the second node is output to the detection signal terminal to obtain the mobility.

8. The display compensation circuit according to claim 7, wherein in a light-emitting display phase, when the third data signal is transmitted to the first node, the second switching transistor and the third switching transistor are turned off under control of the first control terminal and the second control terminal, and the driving transistor outputs driving current for driving the light-emitting element to emit light to the second node.

9. The display compensation circuit according to claim 5, wherein the power supply selection circuit comprises a fourth switching transistor and a fifth switching transistor, wherein the fourth switching transistor has a control electrode coupled to the first switch control terminal, a first electrode coupled to the third node, and a second electrode coupled to the first power supply terminal; and the fifth switching transistor has a control electrode coupled to the second switch control terminal, a first electrode coupled to the third node, and a second electrode coupled to the second power supply terminal.

10. The display compensation circuit according to claim 9, wherein when the fourth switching transistor is turned on and the fifth switching transistor is turned off under control of the first switch control terminal and the second switch control terminal, a signal at the first power supply terminal is transmitted to the third node; and when the fourth switching transistor is turned off and the fifth switching transistor is turned on under control of the first switch control terminal and the second switch control terminal, a signal at the second power supply terminal is transmitted to the third node.

11. The display compensation circuit according to claim 4, wherein the first switching transistor and the second switching transistor are oxide thin film transistors.

12. The display compensation circuit according to claim 1, wherein the power supply selection circuit is shared by a row of pixel circuits.

13. A display apparatus comprising the display compensation circuit according to claim 1.

14. A method for controlling the display compensation circuit according to claim 1, comprising:

controlling, in a threshold voltage detection phase, a first data signal to be transmitted to the first node to obtain a threshold voltage of the driving transistor, controlling, in a mobility detection phase, a second data signal to be transmitted to the first node to obtain mobility of the driving transistor, and controlling, in a light-emitting display phase, a third data signal to be transmitted to the first node to compensate for the driving transistor according to the threshold voltage and the mobility, and controlling the driving transistor to drive the light-emitting element to emit light.

* * * * *